US005152118A

United States Patent [19]

Lancelot

[11] Patent Number: 5,152,118

[45] Date of Patent: Oct. 6, 1992

[54] COUPLINGS FOR CONCRETE REINFORCEMENT BARS

[75] Inventor: Harry B. Lancelot, Hurst, Tex.

[73] Assignee: Richmond Screw Anchor Co., Inc., Fort Worth, Tex.

[21] Appl. No.: 818,443

[22] Filed: Dec. 30, 1991

Related U.S. Application Data

[63] Continuation of Ser. No. 566,659, Aug. 13, 1990, abandoned.

[51] Int. Cl.[5] ..... E04C 3/30

[52] U.S. Cl. ..... 52/726; 52/739

[58] Field of Search ..... 52/726, 223 R, 223 L, 52/225, 227, 228, 736, 740, 726, 739; 403/299, 333; 405/259, 260, 261; 411/411; 10/152 R

[56] References Cited

U.S. PATENT DOCUMENTS

| | | | |
|---|---|---|---|
| 1,849,510 | 3/1932 | Thomson | 403/333 |
| 2,330,686 | 9/1943 | Cornell | 503/333 |
| 2,843,408 | 7/1958 | Stukenborg | 403/299 |
| 3,586,353 | 6/1971 | Lorenz | 403/343 |
| 3,782,839 | 1/1974 | Majewski | 52/740 |
| 4,095,389 | 6/1978 | Oatram et al. | 52/726 X |
| 4,143,986 | 3/1979 | Antosh | 52/726 X |
| 4,619,096 | 10/1986 | Lancelot | 52/726 |
| 4,627,212 | 12/1986 | Yee | 52/726 |
| 4,694,621 | 9/1987 | Locke | 52/726 X |
| 4,730,510 | 3/1988 | Graham | 403/299 |
| 4,955,758 | 9/1990 | Hyde | 405/261 |
| 5,022,791 | 6/1991 | Isler | 411/433 |

FOREIGN PATENT DOCUMENTS

| | | | |
|---|---|---|---|
| 2437199 | 2/1975 | Fed. Rep. of Germany | 52/726 |

*Primary Examiner*—David A. Scherbel
*Assistant Examiner*—Creighton Smith
*Attorney, Agent, or Firm*—Natan Epstein

[57] ABSTRACT

The threaded end of a concrete reinforcement bar is enlarged in diameter so that the thread bottom exceeds the diameter of the surface ribs of the rebar. A coupler sleeve can then be advanced past the end threading and over the rib area, until the rebar end protrudes from the coupler sleeve. This allows splicing of two rebars without axially turning either rebar. Alternatively, the thread bottom does not exceed the maximum diameter of the rib deformations of the rebar but an immediately adjacent rib segment is flattened without removing rib material to preserve the net cross-sectional area of the rebar and maintain the tensile strength of the rebar. A pilot nose of reduced diameter leads the threaded portion into the female thread to facilitate thread alignment and can support a free standing rebar on a female coupling before engaging the threads.

7 Claims, 2 Drawing Sheets

Fig. 1
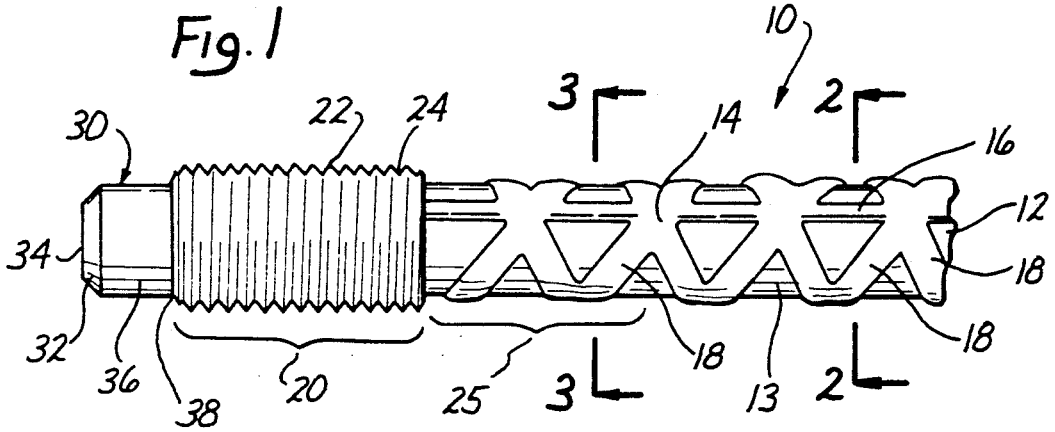
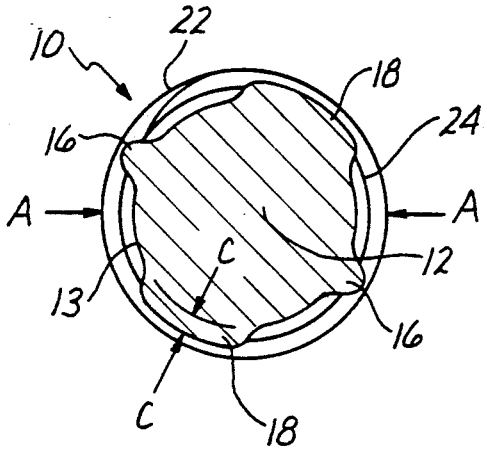
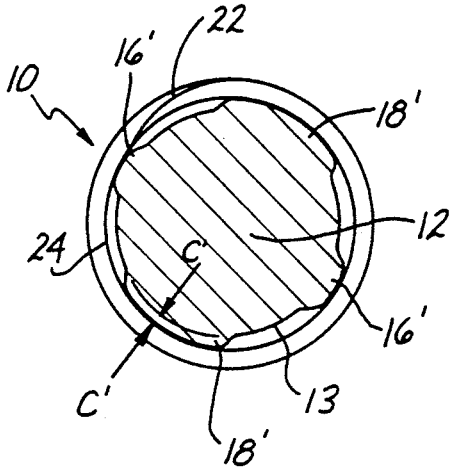
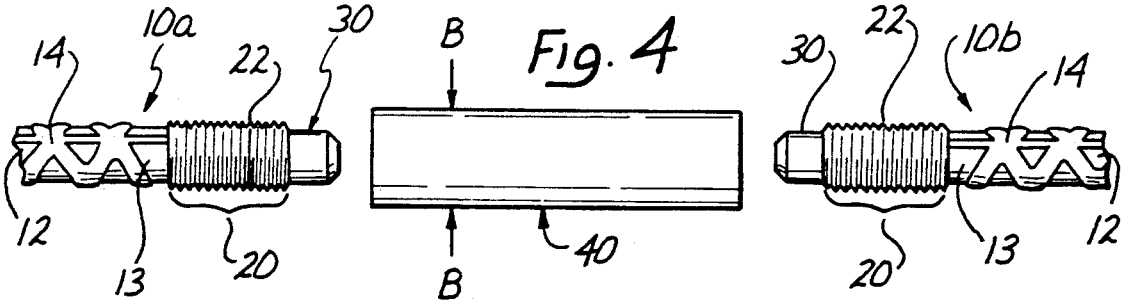
Fig. 4
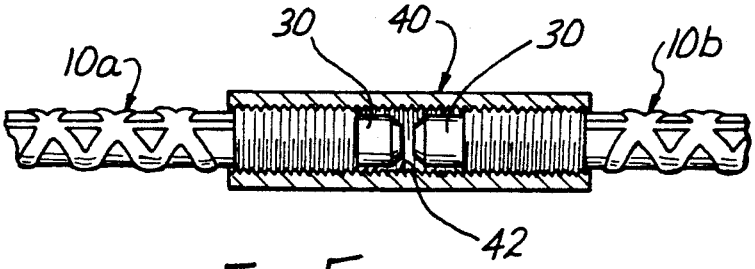
Fig. 5

COUPLINGS FOR CONCRETE REINFORCEMENT BARS

This is a continuation of co-pending application Ser. No. 07/566,659, filed on Aug. 13, 1990, now abandoned.

BACKGROUND OF THE INVENTION

1. Field of the Invention

The present invention pertains generally to the field of reinforced concrete construction and in particular is directed to certain improvements in three-piece couplings for end-to-end splicing of concrete reinforcement bars.

2. State of the Prior Art

A reinforcement bar or, in trade parlance, a rebar, is a long cylindrical steel rod with surface deformations or ribs, the purpose of which is to impede turning or axial displacement of the rod when embedded in concrete. One typical rib configuration includes one or two continuous longitudinal ribs traversed by a plurality of spaced apart annular ribs. Various rib configurations and designs are in use, including oblique annular and helical ribs. A summary of rebar usage may be found at pages A1 through A5 in the appendix to the "Manual of Standard Practice" published by the Concrete Reinforcing Steel Institute (Jan. 1980).

Rebars have been in widespread use for many years as reinforcing elements in poured or cast concrete structures. In construction of large structures it is often necessary to splice together two or more such rebars end-to-end. This often occurs in large concrete form-work which is carried out in steps or stages. The reinforcing bars used at each stage must be joined to rebars for subsequent stages in order to achieve a monolithic concrete structure.

Many rebar splicing devices and couplers have been devised for this purpose. In so-called three piece couplers machine threads are cut or rolled in the ends of the rebars and an internally threaded sleeve joins two bars in an end-to-end splice. This general type of coupler has long been in use. In its most basic form, crude screw threads are cut into the irregular, ribbed surface at each end of a rebar, and two such ends are joined by a threaded cylindrical sleeve. The resulting joint tends to be loose and of low quality because of the rough-cut rebar threading. A better joint is obtained by removing the ribbing to make a smooth cylindrical surface before cutting the threads cut.

Variations of this basic scheme have been adopted in efforts to improve the quality of the splice. One approach is to create a conical taper at each end of the rebar which is then threaded. The threaded ends screw into a sleeve which has equally tapered internal threading, to provide a higher grade joint.

Still another approach has been to enlarge the rebar ends by upset forging or other means, before threading is cut or rolled into the enlarged cylindrical ends. The upset forging of rebar ends was disclosed by this applicant in U.S. Pat. No. 4,619,096 issued Oct. 28, 1986, which however relates to two-piece rebar splicing, in which one rebar end is hot forged to define an integral female threaded receptacle which mates to a male upset threaded rebar end to effect a splice joint. Two-piece couplings can be advantageous in certain applications because a separate coupler sleeve, i.e. a third (piece, is eliminated. In this applicant's prior patent, it is recognized that the upset ends prevent weakening of the rebar's tensile strength after the threads are cut into the enlarged ends. This is because the rebar ends are upset or enlarged in diameter before the threads are cut. This initial thickening of the rebar ends counteracts the effect of the subsequent cutting and prevents the rebars effective cross-section from being reduced by the screw threading.

The '906 patent disclosure is, however, limited to two-piece couplings and does not address the special advantages of upset threaded rebar ends when used in conjunction with a separate coupler sleeve in three-piece couplings.

A considerable shortcoming in conventional three-piece rebar couplings is the necessity to rotate at least one of the rebars about its longitudinal axis in order to make the splice joint. In the typical situation, one rebar may already be in place, embedded in concrete, with one end protruding. The coupler sleeve is then threaded onto the exposed end of the fixed rebar, and the rebar to be joined is then threaded into the free end of the coupler sleeve to make the splice. There are occasions however, when it is inconvenient or impossible to proceed in this manner. For example, it may be impossible to rotate a twenty foot long rebar bent to a right angle at a mid-point in a confined area.

This shortcoming results from the fact that, in conventional three-piece couplers, the coupler sleeve can only be threaded a limited distance onto the rebar, which distance is the length of the threaded portion of the rebar end. This length in turn is no more than can be accepted by the coupler sleeve, as it is undesirable for smooth machine threading to remain exposed outside the sleeve in the completed splice because this results in a weak rebar section of lesser net cross-section than the ribbed rebar body. Movement of the coupler sleeve beyond the threaded end portion is blocked by the surface deformations or ribbing of the rebar which rise above the thread edges and consequently beyond the inside diameter of the coupler sleeve.

Fatigue considerations and cyclic loading presently are not a factor in the construction codes applicable to the design of concrete reinforcement bars. This is changing however and, in anticipation of stricter design codes, the U.S. Government has tested currently used rebar splices under cyclic loading and fatigue conditions. It was found that all rebar splices now on the market fall short of the performance of an unspliced reinforcement bar. It was further found that an unspliced reinforcement bar has approximately a 50% chance of meeting the new cyclic loading standards being considered. Under the old standards for e.g. highway projects such as bridges which are subject to cyclic loading by heavy vehicles passing over these structures, a rebar was acceptable if it survives 2 million cycle of 10–12 thousand psi loading. It is anticipated that the new standards will require 5 million cycles at 30,000 psi.

The ability to achieve a rebar splice through rotation of the coupler sleeve exclusively depends on the ability of the coupler sleeve to move onto the ribbed area of the rebar, unimpeded by the raised rib deformations on the rebar surface.

In the past this has been achieved by "over threading" the rebar: a first machine thread on an upset end portion of the rebar continuing the thread cut over the adjacent ribbed section of the rebar.

Empirical testing has revealed however, that even a small cut or nick in the ribbing of the rebar produces a "cherpe" effect, by which stress force acting along the rebar is focused or concentrated by relatively minute changes in the geometry of the rebar. Even a shallow thread cut in the ribs has been found to create a plane of weakening in the rebar, and under protracted cyclic loading of the rebar as may occur for example, on a concrete bridge subject to heavy loads moving across it, creates a metal fatigue condition at the site of the surface cut which in turn eventually leads to structural failure of the rebar. Consequently, the expedient of extending the machine thread onto the rib deformations in order to allow the coupler sleeve to move onto the ribbed rebar area, sometimes referred to as double threading, is undesirable if a rebar splice is to approximate the performance of a continuous rebar.

For these same reasons, the three-piece coupler system described herein is preferable to a two-piece coupler system such as described in this applicant's prior Pat. No. 4,619,096 in applications where reliability under metal fatigue conditions is of concern. The elements in a three-piece coupling are straight cylindrical rods or sleeve with no abrupt changes in geometry, in contrast to the abrupt transition between the nominal rebar area and the enlarged integral end socket in the two-piece system.

SUMMARY OF THE INVENTION

According to this invention, the aforementioned difficulties can be overcome by upsetting the rebar ends sufficiently so that the end threading is of a diameter greater than the maximum diameter achieved at any point of the surface ribs. The enlarged diameter of the upset threaded portion can be achieved by hot forging of the rebar or any equivalent method. The inside end of the coupler sleeve can then be advanced onto the nominal rebar area, beyond the end threading, until the rebar end protrudes from the outside end of the coupler sleeve. This allows splicing of two rebars without necessity of axially turning either rebar. The second rebar is simply brought end-to-end with the protruding end of the fixed rebar and the coupler sleeve is turned in the opposite direction to bring it back over the joined rebar ends, thereby making the splice joint.

In a presently preferred form of the invention, the upset end of the rebar is enlarged to a diameter such that a coupler sleeve can be threaded beyond the male threads and clear the deformations on the ribbed area of the area. In other words, the bottom of the thread groove in the upset rebar end has a diameter at least slightly greater than the maximum diameter of the rib deformations. In another form of the invention, the rebar end is upset to a lesser degree such that the bottom of the thread groove does not exceed the maximum diameter of the rib deformations of the rebar. In order to allow the coupler sleeve to be moved beyond the upset threaded portion and onto the ribbed area, the ribs on a rebar segment immediately adjacent to the upset threaded portion are flattened by means of dies to a lesser height but without removing any significant amount of the rib material, so that the effective cross-sectional area of the rebar at the flattened portion remains substantially unchanged, thereby maintaining the tensile strength of the rebar.

A further improvement according to this invention is the provision of a pilot nose at the threaded end of the rebar. The pilot nose is an axial protrusion of reduced diameter which leads the threaded portion into the coupler sleeve, or other female threaded element, in order to facilitate the insertion and alignment of the mating threads. Because of the long length of the typical rebar, construction workers often have some difficulty in threading a second rebar into a coupler sleeve previously fitted on a fixed first rebar. The novel pilot nose ensures that, once it is inserted into the coupler sleeve, the male threads following behind it will be in proper axial alignment with the internal female threading of the sleeve. Proper engagement of the threads will then occur simply by then turning the rebar. Without the pilot nose, it is often a matter of several ineffectual attempts before proper engagement of the threads is achieved. The pilot nose is preferably a smooth cylindrical stub with a bevelled leading edge terminating in a circular end face of smaller diameter than either the cylindrical stub portion or the screw threads on the rebar, in order to facilitate entry of the pilot nose into the coupler sleeve or female coupling element being joined to the rebar.

Still another feature according to this invention is that the pilot nose is sized and configured so as to support a rebar vertically erect on a vertically aligned coupler sleeve or other female coupling, without engaging the threads of the rebar with those of the female element. The rebar can be left otherwise unsupported and free standing simply by inserting the pilot nose into a securely anchored female coupler. This is a useful feature in construction work since it allows the personnel to quickly set up a number of rebars and clear an area before individually twisting the rebars into the corresponding coupler element. Without provision of such a pilot nose, each rebar must be threaded into the coupling element before the worker can pick-up another rebar for placement into its socket or coupler. This pilot nose is useful not only with coupler sleeves but with any coupling element, socket or fixture having a threaded bore into which the rebar is to be mated.

These and other advantages and improvements of this invention will be better understood by reference to the following detailed description of the invention and attached drawings.

BRIEF DESCRIPTION OF THE DRAWINGS

FIG. 1 shows a rebar end with upset threading and a pilot nose according to this invention:

FIG. 2 is a cross-section of the rebar taken along line 2—2 in FIG. 1 showing the normal ribbing height in the nominal rebar area;

FIG. 3 is a cross-section taken along line 3—3 in FIG. 3 showing ribbing flattened adjacent to the upset threaded portion of the rebar;

FIG. 4 is an axially exploded view showing a coupler sleeve between two upset threaded rebar ends;

FIG. 5 shows the elements of FIG. 4 joined to make a splice between the two rebars;

DETAILED DESCRIPTION OF THE INVENTION

Figure 1A:
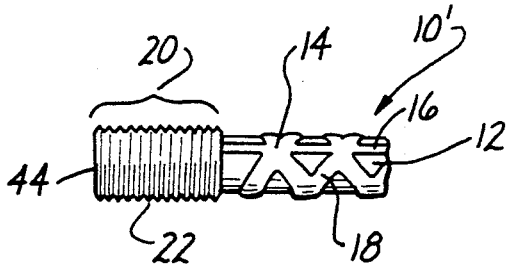
FIG. 1*a* shows an alternate rebar end with upset threading but without a pilot nose.

With reference to the drawings, FIG. 1 shows one end of a concrete reinforcement bar or rebar 10 which has a basic cylindrical body 12 with an outer cylindrical surface 13 from which rise deformations or ribs 14 as best seen in the cross section of FIG. 2. The ribs 14 may take different shapes and in the illustrated example include two diametrically opposed longitudinal ribs 16 and axially spaced, crisscrossed pairs of oblique annular ribs 18 which intercept each other at the longitudinal rib 16.

FIG. 1 shows the left hand end of a rebar which is considerably longer than shown and terminates in an opposite, right hand end which may or may not be similar to the left hand end. In the typical rebar, both ends will be substantially similar and approximately mirror images of each other. Between the two ends is a long nominal rebar area, and which is characterized by the aforementioned rib deformations 14 on the cylindrical surface 13. The rib deformations 14 are hot rolled on an originally cylindrical rebar body in a manner well-known in the industry. Rebar lengths range to 60 feet or greater, with more typical lengths ranging between 20 and 40 feet. Shorter lengths are also used. Rebar diameters vary and are available in standard sizes which in the industry are designated by numerals in the range of 4 through 14, for the standard commonly used sizes. The height of the ribbed deformations 14 are typically 2/10 of the nominal rebar diameter.

According to this invention, an end segment 20 of the rebar has been enlarged in diameter by upset forging, and a machine thread 22 has been cut or rolled into the upset section 20. The extent of the upset i.e. the degree of diametric enlargement of the rebar along section 20 is such that the bottom 24 of the thread 22 has a diameter which is intermediate the diameter of the cylindrical rebar surface 12 and the maximum diameter achieved by the highest point of the rib deformations 14, including the longitudinal ribs 16 and the annular ribs 18. The height of the threading 22 above the thread bottom 24 will be determined by the thread size which in turn may relate to the diameter of the rebar, among other factors. The absolute dimensions of the thread 22 and upset diameter of section 20 consequently vary in proportion to the rebar diameter. The threaded upset section 20 of the rebar has a preferred length of one rebar diameter plus ¼ inch.

The up-sized section 20 is formed by holding the hot rebar in a die which defines a cylindrical compartment surrounding an exposed three inch end segment of the rebar. An axial hydraulic ram strikes the still-hot end of the rebar with sufficient force and as many repetitions as needed to expand the exposed rebar segment to the diameter of the die chamber, shortening the exposed segment in the process. The machine thread 22 is then either cut or rolled on the up-sized segment 20.

The preferred extent of up-sizing of the end segment 20 is typically to a final diameter which is ⅛th of 1 inch in diameter greater than the nominal rebar diameter. The nominal diameter, a figure which is arrived at in a specific manner known in the industry, and given in Table 1 below for each rebar size, is approximately the diameter of the rebar body at surface 13, but may vary somewhat therefrom for certain rebar sizes. The rib deformations 14 in this area and, for the smaller rebar e.g. sizes 4–8, will rise to a maximum rib height typically less than the ⅛ inch up-sizing of section 20. This extent of up-sizing will allow an internally threaded cylindrical sleeve to be moved past the threaded end segment 20 and onto the ribbed area of the rebar without being obstructed by the deformations 16, 18.

As an alternative, particularly in the larger rebar sizes 9 through 14 in which substantial up-sizing is more difficult, a lesser enlargement of the threaded section 20 may be combined with a flattening or squeeze-down of the rib deformations 14 to a diminished rib height along a segment 25 of the nominal rebar area 12 adjacent to the up-sized section 20. This flattening can be accomplished, for example, by means of a hydraulic gripper arrangement including two semi-cylindrical dies configured to each cradle one longitudinal half of the rebar segment being treated. Two such dies are applied in diametrically opposed relationship to the rebar segment while the rebar is at hot forging temperatures with sufficient hydraulic force to achieve a flattening of the rib deformations 16, 18. Such hydraulic grippers are effective in reducing the height of the ribbed deformations without however, removing any significant amount of rebar material. As a result, the effective or net cross-sectional area of the rebar remains constant as illustrated in FIGS. 4 and 5. FIG. 4 shows the cross-section taken along line 4—4 in FIG. 1, where the rib deformations retain their original shape and height above the rebar body 12. In FIG. 5, the ribs have been flattened by means of the aforedescribed hydraulic grippers, resulting in rib deformations which are of reduced height and also somewhat spread out in a circumferential direction as compared to the original shape of FIG. 4. While the cross sectional shape is changed somewhat by this flattening, the net cross sectional area remains substantially unchanged, so that the tensile strength of the rebar is not impaired by this process.

| A | B | C | D | E | F | G (2) | H | I (3) | J | K | L (1) |
|---|---|---|---|---|---|---|---|---|---|---|---|
| | | | COUP- | STARTING O.D. | | THD. | THD. | REDUC- | NOMIN- | OVER- | |
| BAR SIZE | THREAD SIZE | DRILL DIA. | LER OD | UPSET/ ROLLED | UPSET CUT | CLR. LGTH. REQD. | CLR. DIA. | TION REQD. | AL BAR DIA. | ALL BAR DIA. | MIN. AVG. HGT OF D |
| #4 | ⅝"-11 | 0.531 | ⅞" | 0.568 | 0.625 | 1.000 | 0.527 | 0.035 | 0.500 | 0.562 | 0.020 |
| #5 | ¾"-10 | 0.656 | 1⅛" | 0.687 | 0.750 | 1.125 | 0.642 | 0.045 | 0.625 | 0.688 | 0.028 |
| #6 | ⅞"-9 | 0.766 | 1¼" | 0.805 | 0.875 | 1.250 | 0.755 | 0.120 | 0.750 | 0.875 | 0.038 |
| #7 | 1"-8 | 0.875 | 1½" | 0.921 | 1.000 | 1.375 | 0.875 | 0.125 | 0.875 | 1.000 | 0.044 |
| #8 | 1⅛"-8 | 1.000 | 1⅝" | 1.046 | 1.125 | 1.500 | 1.000 | 0.125 | 1.000 | 1.125 | 0.050 |
| #9 | 1¼"-8 | 1.125 | 1⅞" | 1.171 | 1.250 | 1.625 | 1.125 | 0.125 | 1.128 | 1.250 | 0.056 |
| #10 | 1 7/16"-8 | 1.313 | 2⅛" | 1.359 | 1.437 | 1.813 | 1.302 | 0.135 | 1.270 | 1.438 | 0.064 |
| #11 | 1 9/16"-8 | 1.438 | 2¼" | 1.484 | 1.562 | 2.208 | 1.427 | 0.198 | 1.410 | 1.625 | 0.071 |

-continued

| A BAR SIZE | B THREAD SIZE | C DRILL DIA. | D COUPLER OD | E STARTING O.D. UPSET/ ROLLED | F STARTING O.D. UPSET CUT | G (2) THD. CLR. LGTH. REQD. | H THD. CLR. DIA. | I (3) REDUCTION REQD. | J NOMINAL BAR DIA. | K OVERALL BAR DIA. | L (1) MIN. AVG. HGT OF D |
|---|---|---|---|---|---|---|---|---|---|---|---|
| #14 | 1⅞"-8 | 1.750 | 2⅝" | 1.796 | 1.875 | 2.250 | 1.740 | 0.135 | 1.693 | 1.875 | 0.085 |

NOTE: (1)THE MINIMUM AVERAGE HEIGHT OF DEFORMATIONS IS FOR EACH DEFORMATION.
(2)THE LENGTH OF SQUEEZE DOWN GIVEN ALLOWS FOR THREADING THE COUPLER ENOUGH TO ALLOW DI'S TO TOUCH TIP TO TIP AND PILOTS WILL STILL FUNCTION.
(3)THE REDUCTION REQUIRED FROM OVERALL BAR DIAMETER TO CLEAR THE COUPLER INSIDE DIAMETER

TABLE 1 lists presently preferred dimensions for the upset end threading, rib squeeze-down, and related data for rebar sizes 4 through 14.

Column B gives the thread size, in inches as well as in industry-recognized thread number. The thread numbers become smaller for larger sized threads. The thread dimension in inches indicates the diameter, A—A in FIG. 2, of the thread 22 from crest to crest in the upset threaded segment 20 in FIG. 1. Column D gives the drill diameter i.e., the thread diameter measured at the thread bottom 24 of section 20 in FIG. 1. This dimension corresponds to the crest diameter of the female threading in the coupler sleeve 40 of FIGS. 4 and 5.

Column C provides the outside diameter of the coupler 40 in FIGS. 4 and 5 for each rebar size. This is dimension B—B in FIG. 4. Columns E and F indicate the degree of diametric enlargement along the upset section 20 prior to formation of the thread 24: column E gives the outside diameter required for rolled thread 24, while Column F gives the same dimension for thread 24 which is cut instead of rolled. Column G gives the length of the rebar segment 25 in FIG. 1, adjacent to threaded segment 20, along which the ribbing 14 is squeezed down from the normal height C—C in FIG. 2 to a flattened condition C'—C' in FIG. 3, to allow the coupler sleeve 40 to be threaded onto this squeezed down ribbed area of the rebar, past the inside end of the thread 24. Column I gives the rib height squeeze-down reduction required i.e. the reduction from overall bar diameter required to clear the inside diameter of the coupler sleeve 40 for each rebar size.

Columns J and K respectively provide the nominal and overall rebar diameters along the ribbed portions of the rebar in FIG. 1 for each industry standard rebar size, while Column L gives the industry minimum average height of the deformations 14 above the cylindrical rebar surface 15.

The length of the squeeze down indicated in Column I allows threading of the coupler sufficiently over the ribbed area to allow two rebar ends to touch tip to tip, while retaining function of the pilot noses 30 on each rebar being joined.

In a preferred form of this invention, the rebar 10 has a pilot or lead-in nose 30 at each end, which is a cylindrical end stub extending axially from the upset threaded rebar segment 20. The pilot nose 30 is integral with the rebar 10 and is formed by hot forging, hot rolling or other convenient process. The nose 30 terminates in a circumferentially bevelled edge 32 and an end face 34. The cylindrical body 36 of the nose 30 has a diameter slightly lesser than the crest of the threading 42 on the female element to be screwed onto the rebar thread 22. In other words, the diameter of the nose is slightly lesser than the diameter at the bottom 24 of the rebar thread 22. The lead-in nose 30 may be omitted in an alternate form of this invention illustrated in FIG. 1*a*, which shows an alternate rebar 10, without the pilot nose 30 so that the upset thread 22 terminates in a blunt end face 44, but which is otherwise analogous to the rebar 10 of FIG. 1.

Turning now to FIG. 2, two rebars 10*a* and 10*b* each have an upset threaded end segment 20 and pilot nose 30 as described in connection with FIGS. 1, 4 and 5. The two rebar ends are shown on either side of a coupler sleeve 40. The sleeve is an internally threaded cylindrical tube open at both ends. The internal threading 42 is sized to mate with the rebar end threading 22. The sleeve is made of the same material as the rebars and preferably has an outside diameter (B—B in FIG. 4) such that the net cross-sectional area of sleeve 40 is at least 40% greater than the net cross-sectional area of the rebars. It has been found through empirical testing that this relationship between the coupler and rebar net cross sectional areas is critical to reliability of the splice joint in situations where metal fatigue must be taken into account. Metal fatigue occurs most commonly in structures which are cyclically stressed by heavy loads, such as bridges. The axial length of the coupler sleeve 40 is preferably no greater than required to fully admit the threaded end segments 20 of both rebars being joined as illustrated in FIG. 5. With this length, a worker can easily gauge that the sleeve is properly mounted to a rebar as soon as none of the threading of end segment 20 remains visible. This will be true regardless of which end of the coupler is threaded to either one of the rebars being joined.

An end-to-end rebar splice is made between rebars 10*a* and 10*b* by screwing the sleeve 40 onto the end of one rebar, e.g. 10*a*, and then screwing the end of the other rebar 10*b* into the opposite end of the coupler sleeve 40. A completed splice joint is shown in FIG. 5 where the threaded ends of both rebars 10*a* and 10*b* have been rotated into the coupler sleeve 40 until the threading 22 on each rebar is fully engaged with the internal threading 42 of the coupler sleeve 40.

Figure 6A:
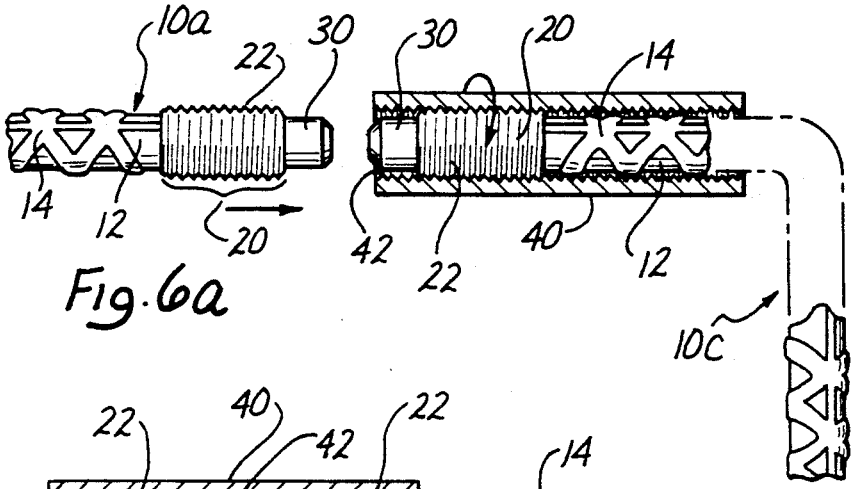
FIG. 6*a* illustrates how a bent rebar can joined to a fixed rebar without turning either rebar.
Figure 6B:
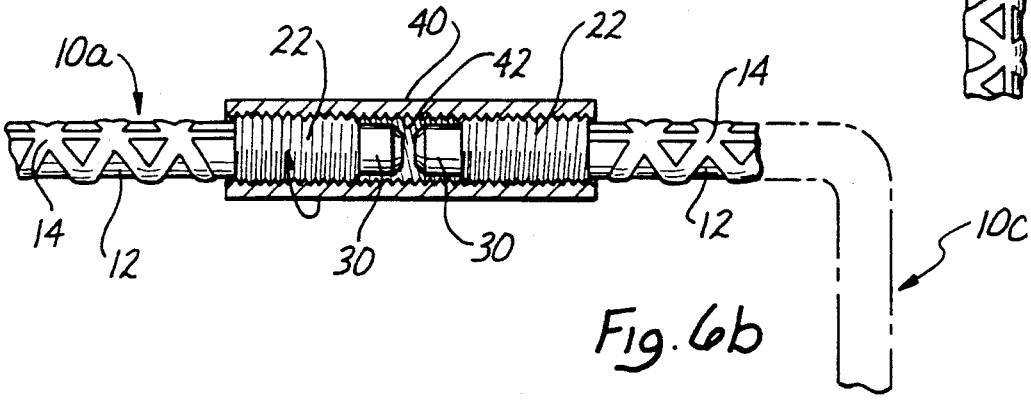
FIG. 6*b* shows a completed splice between the rebars of FIG. 6*a;*

Turning now to FIGS. 6*a* and 6*b*, is a situation is illustrated where one of the rebars, 10*c* is pre-bent to a right angle, as is common in construction practice. When the bent rebar 10*c* is to be engaged to rebar 10*a* which may have already been embedded in concrete (not shown) it will usually be found that rebar 10*c* cannot be rotated about the splice axis because of its length. This difficulty is easily overcome by threading the coupler sleeve 40 onto the end of the bent rebar 10*c* until a substantial portion of the sleeve 40 extends over the ribbed area 14 of the rebar, well past the up-sized threaded section 20. The exposed end of rebar 10*c* can now be brought end-to-end, or nose-to-nose, with the fixed rebar 10*a* and the coupler sleeve 40 then rotated back onto the end of the fixed rebar, to complete a splice joint as in FIG. 6*b*, without rotating either rebar in the process.

The pilot nose 30, aided by the bevelled edge 32 is useful in easily aligning a rebar into the open end of a coupler sleeve, a task which otherwise is not easy due to the considerable length and clumsy handling of the rebars once correct axial alignment has been achieved, threading of the rebar into the coupler sleeve is greatly facilitated in that cross threading of the rebar with the coupler sleeve is avoided. All of this translates into quicker handling and assembly of the rebars at the construction site which is directly reflected in time and cost savings.

Figure 7B:
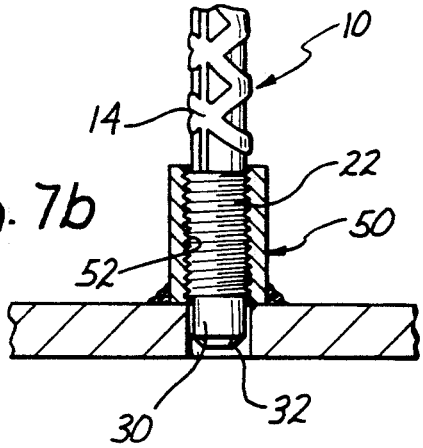
FIG. 7*b* shows the rebar of FIG. 7*a* threaded into the female fitting.
Figure 7A:
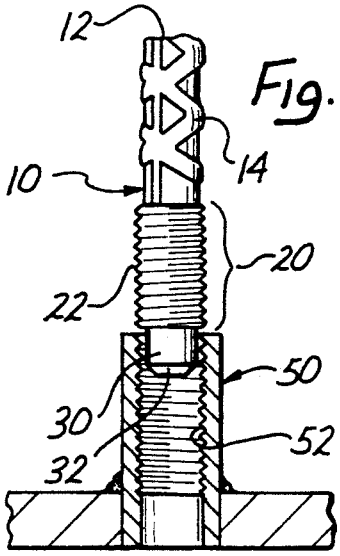
FIG. 7*a* shows the pilot nose of the rebar leading the threading into a female fitting and supporting the rebar in free standing upright condition on the fitting.

The presently preferred length of lead-in nose 30 is one-half inch in length from the end face 34 to the transition 38 with the up-sized threaded section 20. The diameter of the nose 30 makes a close sliding fit with the crest of the thread 42 in the coupler sleeve 40. The close fit enables the rebar 10 to be left upright and free-standing on a female fitting 50 having an internally threaded bore 52 adapted to engage the rebar threading simply by sliding the lead-in nose 30 into the open end of the fitting. This is shown in FIG. 7*a*. The pilot nose 30 inserted in female threading 52 supports upright the rebar 10 without engagement between threads 22 and 52. In the case of larger rebars, a somewhat longer nose 30, e.g. ¾ inch long, may be required to achieve this result. FIG. 7*b*shows the rebar 10 of FIG. 7*a* after threading rebar thread 22 into the female fixture 50.

From the foregoing, it will be appreciated that various improvements have been disclosed to facilitate the splicing or end-to-end coupling of concrete reinforcement bars in an expeditious and reliable manner. While particular dimensions and other details of the presently preferred embodiments have been described and illustrated for purposes of clarity and example, it must be understood that many changes, substitutions and modifications will be readily apparent to those individuals possessed of ordinary skill in the art without thereby departing from the scope and spirit of the present invention which is defined only by the following claims.

What is claimed is:

1. In a structural reinforcement bar for embedding in pored concrete construction of the type having a cylindrical bar body of nominal diameter with raised deformations extending on said body between two opposite bar ends, the improvement comprising:

an end segment of enlarged diameter at one or both of said ends, a thread on said segment for engaging an internally threaded coupling element, characterized in that the bottom of said thread has a thread diameter intermediate said nominal diameter and the maximum diameter of said deformations thereby to preserve the tensile strength of said reinforcement bar; and said deformations with a region immediately adjacent to said end segment being compressed to a flattened condition of reduced maximum diameter lesser than said thread diameter without substantial reduction in total cross-sectional area of said body to allow unimpeded threading of a portion of said coupling element past said segment and over said deformations.

2. The reinforcement bar of claim 1 further comprising a pilot nose extending axially from said end segment, said pilot nose including a nose body portion dimensioned to make a sliding fit with the crest of female threading in said coupling element and operative for establishing axial alignment between said reinforcement bar and said coupling element thereby to facilitate subsequent threading engagement of said bar with the coupling element.

3. The reinforcement bar of claim 2 wherein said pilot nose is of sufficient length to support said bar in free-standing vertically upright position when said pilot nose is inserted into a vertical female thread sized to mate with the male thread on said end segment.

4. The reinforcement bar of claim 3 wherein said pilot nose has a beveled end edge to facilitate insertion into said female thread.

5. A three-piece splice between adjacent ends of two structural reinforcement bars for embedding in poured concrete construction, each bar having a cylindrical body of nominal diameter with raised deformations on said body intermediate two opposite ends, comprising:

each of said adjacent ends having an end segment of enlarged diameter relative to said nominal diameter, a male thread on said segment characterized in that the bottom of said threading has a thread diameter intermediate said nominal diameter and the maximum diameter of said deformations thereby to preserve the tensile strength of said reinforcement bar;

coupling sleeve open at opposite ends and internally threaded continuously between said ends for mating with said male thread, said sleeve being substantially longer than said end segment of enlarged diameter;

at least one of said bars characterized in that said deformations within a region immediately adjacent to said end segment are compressed to a flattened condition of reduced maximum diameter lesser than said thread diameter without substantial reduction in total cross-sectional area of said body to allow said coupling sleeve to be threaded entirely onto said end segment and over said compressed deformations of said least one bar without interference between said internal thread and said flattened deformations.

6. A three-piece splice between adjacent ends of two structural reinforcement bars for embedding in poured concrete construction, each bar having a cylindrical body of nominal diameter with raised deformations on said body intermediate two opposite ends, comprising:

each of said adjacent ends having an end segment of enlarged diameter relative to said nominal diameter immediately adjacent to a diametrically unenlarged portion of said body, a male thread on said segment characterized in that the bottom of said thread has a diameter at least equal to the maximum diameter of said deformations thereby to preserve the tensile strength of said reinforcement bar;

a coupling sleeve open at opposite ends and internally threaded continuously between said opposite ends for mating with said male thread, said sleeve being substantially longer than said end segment of enlarged diameter;

whereby said coupling sleeve can be advanced past said end segment and onto said unenlarged portion of said body.

7. A method for clearing a construction site of reinforcement bars comprising the steps of:

providing an internally threaded female element set in concrete at said site with an internal thread oriented vertically;

providing a structural reinforcement bar of the type used for embedding in cast concrete construction, said bar having a cylindrical bar surface inch and rib deformations rising radially from said surface and extending between opposite bar ends, a male thread on a segment at one or both said ends for engagement with said female element, a pilot nose extending axially from one or both said ends, said pilot nose including a cylindrical portion between 0.5 and 0.75 inches long axially aligned with said cylindrical bar surface and having an outside diameter dimensioned to make a close sliding fit with the crest of the internal thread of said female element for establishing axial alignment between said reinforcement bar and said element thereby to facilitate subsequent threading engagement therebetween; and inserting said pilot nose into said internal thread without engaging said male thread to said internal thread thereby to support said bar in freestanding upright position on said female element.

* * * * *